United States Patent [19]

Gillette et al.

[11] 4,426,863

[45] Jan. 24, 1984

[54] CONTAINER SECURING DEVICE

[75] Inventors: Jeffrey L. Gillette, Pittsburgh; Donald W. Hillery, Lower Burrell, both of Pa.

[73] Assignee: PPG Industries, Inc., Pittsburgh, Pa.

[21] Appl. No.: 319,853

[22] Filed: Nov. 9, 1981

[51] Int. Cl.[3] ..... B65D 55/14; F16B 41/00

[52] U.S. Cl. ..... 70/164; 70/230

[58] Field of Search ..... 70/158, 163, 164, 165, 70/166, 167, 168, 169, 170, 171, 172, 173, 174–180, 229, 230

[56] References Cited

U.S. PATENT DOCUMENTS

| | | | |
|---|---|---|---|
| 983,842 | 2/1911 | Schneible . | |
| 1,379,669 | 5/1921 | Wilson | 70/170 |
| 1,599,685 | 9/1926 | Spaeth . | |
| 1,636,641 | 7/1927 | Lewis . | |
| 1,656,686 | 1/1928 | Tjepkes | 70/170 |
| 1,711,535 | 5/1929 | Leet | 70/158 |
| 1,762,582 | 6/1930 | Nunes . | |
| 1,814,343 | 7/1931 | Smith | 70/230 |
| 2,297,579 | 9/1942 | Norberg | 70/164 |
| 2,748,794 | 6/1956 | Dodds | 137/385 |
| 3,930,389 | 1/1976 | Buikus | 70/164 |
| 4,126,023 | 11/1978 | Smith et al. | 70/177 |

FOREIGN PATENT DOCUMENTS

| | | | |
|---|---|---|---|
| 389215 | 1/1924 | Fed. Rep. of Germany | 70/165 |

*Primary Examiner*—Robert L. Wolfe

*Attorney, Agent, or Firm*—Thomas M. Breininger

[57] ABSTRACT

Disclosed is a device for securing a first article such as a bung in a second article such as the substantially closed end of a container having a receptacle for receiving the bung. The device comprises means mounting selected portions of the first article and selected portions of the second article for rotating the first article in the second article in a first direction a predetermined distance to capture the first article in the second article and means mounting the first article and engaging the second article to permit rotation of the first article relative to the second article in a direction opposite to the first direction and to limit rotation in the direction opposite to a distance less than the predetermined distance.

10 Claims, 12 Drawing Figures

CONTAINER SECURING DEVICE

BACKGROUND OF THE INVENTION

The advantages of being able to secure containers such as barrels or drums from unauthorized access to the interior by means of a relatively simple securing device will be appreciated generally. For example, access by unauthorized persons to the interiors of containers for the storage or transport of hazardous materials is of concern to people generally whether they are involved with such materials directly or are members of the public at large.

SUMMARY OF THE INVENTION

The present invention is a device for securing a first article, such as a bung, in a second article, such as the head or substantially closed end of a drum or barrel having a hole defined by a receptacle adapted for rotationally receiving the bung. Means mounting selected portions of the first article and selected portions of the second article are provided for rotating the first article in the second article in a first direction a predetermined distance to capture the first article in the second article. The device also contains means, such as a slotted locking plate optionally having a bar, rod, tube, or other member, for mounting the first article and engaging the second article to permit rotation of the first article relative to the second article in a second direction opposite to the first direction and to limit rotation in the second direction to a distance less than the predetermined distance.

DETAILED DESCRIPTION OF THE INVENTION

Figure 1:
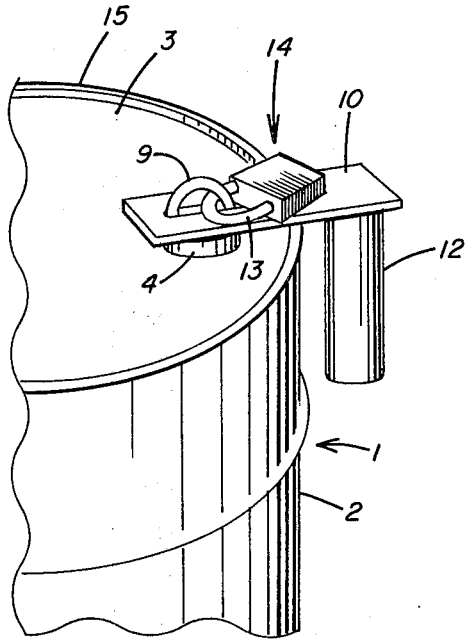
FIG. 1 represents a view in perspective of an embodiment of the invention in assembled form.
Figure 2:
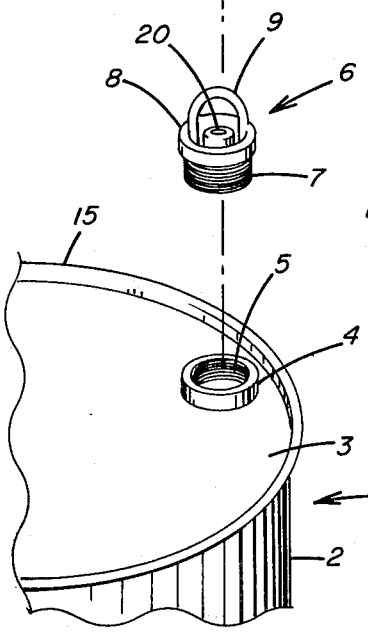
FIG. 2 represents a view in perspective of the embodiment represented in FIG. 1 but in an unassembled condition.

FIGS. 1 and 2 illustrate a first embodiment of the invention. The container 1 such as a barrel or drum as represented in this embodiment has a cylindrical wall 2 and a substantially closed end 3. In the substantially closed end 3 is a receptacle 4 such as a cylindrical lip or flange defining a hole in the substantially closed end 3 of the container 1 for permitting access to the interior of the container 1. The receptacle 4 contains means such as, in this embodiment, internal screw shaped threads 5 for rotatably receiving a bung 6 having cooperating means for engaging the receptacle 4 such as, in this embodiment, a generally cylindrical wall provided with screw shaped threads 7 on the external surface thereof for rotatably engaging the receptacle 4.

The bung 6 has an upper end 8 preferably containing a vent 20, having rigid with the upper end 8 therewith an outwardly projecting member 9 having an aperture adapted for receiving means for locking the device, which outwardly projecting member in this embodiment is a latch ring 9 having an aperture for receiving the shackle 13 of a padlock 14. In this embodiment, the latch ring 9 lies in a plane approximately normal, and preferably normal to, the upper end 8 of the bung 6.

A locking plate 10, which in this embodiment has an elongated shape, has a closed slot 11 for receiving the outwardly projecting member 9 such as the latch ring 9 of the upper end 8 of the bung 6. The locking plate 10 has rigid therewith and, in this embodiment projecting approximately perpendicular therefrom, and preferably perpendicularly therefrom, a member 12 such as a solid or hollow bar, a solid rod, or a pipe in approximately longitudinal relationship to the slot 11 in the locking plate 10. The length of the locking plate 10 and the length of the member 12, such as the solid or hollow bar, solid rod, or pipe, may of course vary provided that they are of sufficient lengths such that when the securing device is in assembled form, the rotation of the bung 6 in the receptacle 4 is at least partially restricted by the contact of the member 12 with the outside wall 2 of the container 1 and/or by contact with the perimeter of the lip 15 of the substantially closed end 3 of the container 1. In addition to the advantages provided by the securing device of this embodiment of the invention in helping to prevent unauthorized access to the interior of the container, once the securing device is unlocked and the locking plate having rigid therewith, for example, the bar, rod or pipe, is removed from the bung, the locking plate may be turned over to engage the projecting member of the bung and used as a wrench to assist in removing the bung from the container.

Figure 3:
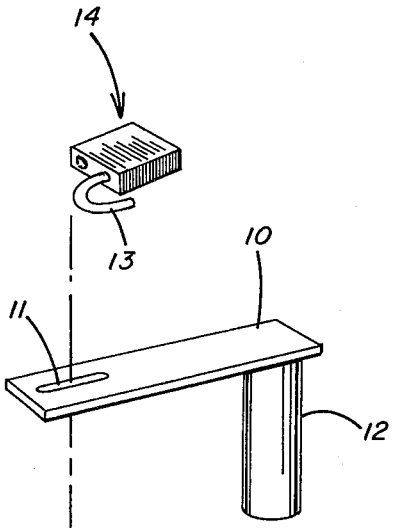
FIG. 3 represents a view in cross section of a vented bung containing a latch ring.
Figure 3:
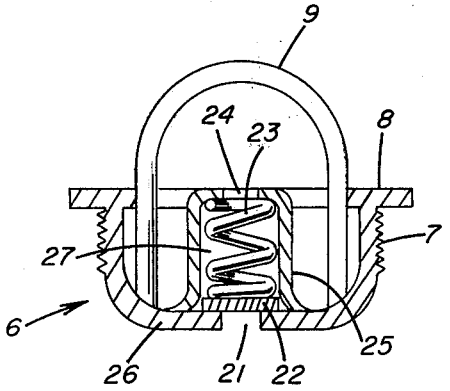

The optional vent (not fully shown in FIG. 2) in the bung 6 is illustrated in cross section in FIG. 3. As shown in FIG. 3, the bung 6 has an inside wall 25 defining a cavity 27 fitted with a spring 23 which contacts the upper inside of the wall 25 containing the opening 24 and also contacts a disc 22 which covers the opening 21 in the bottom wall 26 of the bung.

In a second, less preferred embodiment suitable, for example, where the substantially closed end 3 of the container 1 has a lip 15 of suitable height, the locking plate 10 and the member 12 are of appropriate lengths such that when the locking plate 10 engages the latch ring 9 by means of slot 11, the rotation of the bung 6 in the receptacle 4 is at least partially restricted by contact of the member 12 with the lip 15 at a position on the lip 15 facing the interior of the surface of the substantially closed end 3 of the container 1.

Figure 11:
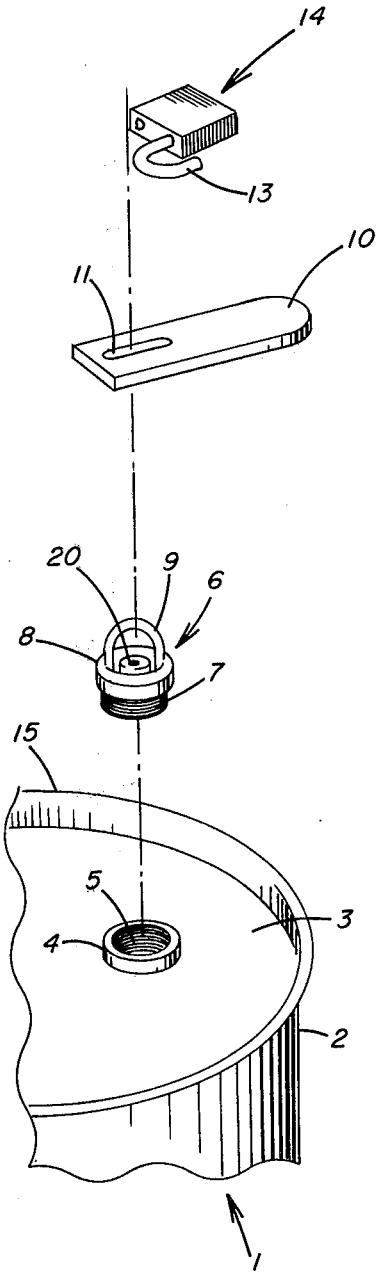
FIG. 11 represents a view in perspective of an embodiment of the invention in an unassembled condition.
Figure 12:
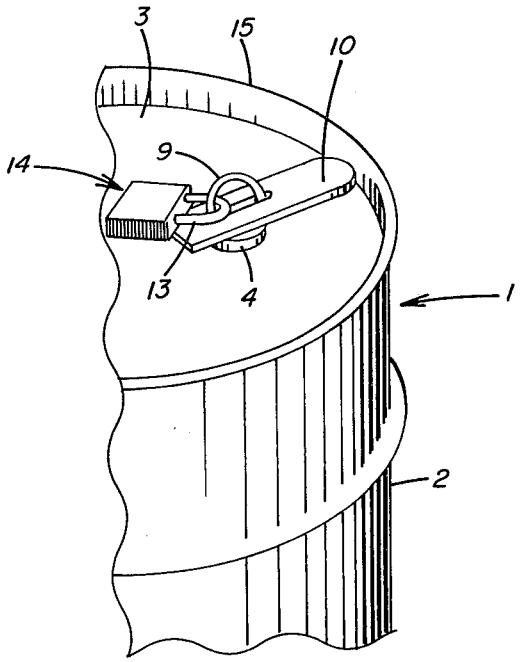
FIG. 12 represents a view in perspective of the embodiment represented in FIG. 11 but in an assembled condition.

In a third, less preferred embodiment (illustrated in FIGS. 11 and 12) suitable, for example, where the substantially closed end of 3 of the container 1 has a lip 15 of suitable height, there is no member 12 on locking plate 10, and the locking plate 10 is of appropriate length such that when the locking plate 10 engages the latch ring 9 by means of slot 11, the rotation of the bung 6 in the receptacle 4 is at least partially restricted by contact of the end of locking plate 10 at a position distal from slot 11 with the lip 15 at a position of the lip 15 facing the interior of the surface of the substantially closed end 3 of the container.

Figure 4:
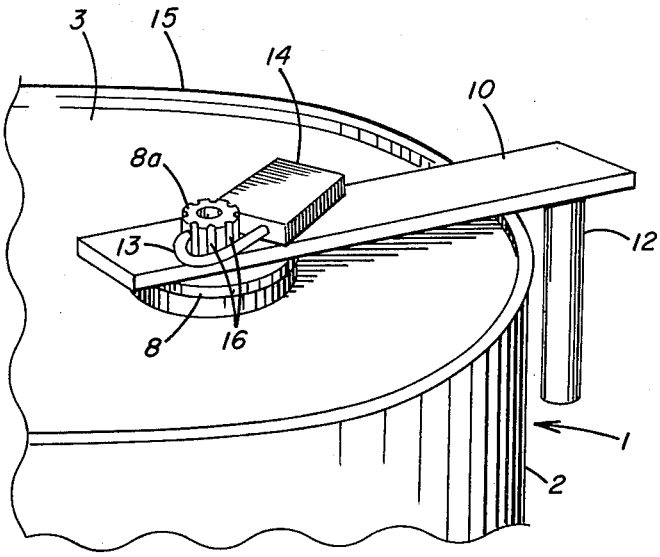
FIG. 4 represents a view in perspective of another embodiment of the invention.
Figure 5:
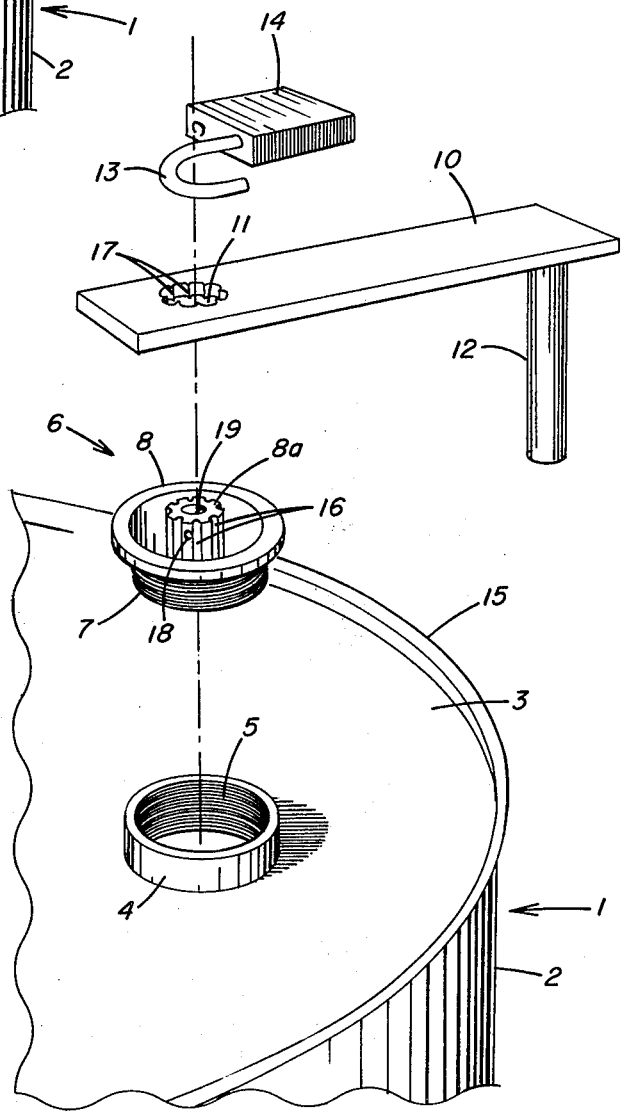
FIG. 5 represents a view in perspective of the embodiment represented in FIG. 4 but in an unassembled condition.

FIGS. 4 and 5 represent a fourth and preferred embodiment of the invention. The container 1 having cylindrical wall 2, substantially closed end 3 and receptacle 4 is the same as in the first embodiment of the invention described above. However, in this preferred embodiment, there is no latch ring 9 on the bung 6. Instead, a central cylindrical portion 8*a* of the upper end 8 of the bung 6 projects upward from the bung 6 and contains notches 16 in the region of the external cylindrical surface of the central cylindrical portion 8*a*. The closed slot 11 in the locking plate 10 in this embodiment is approximately circular in shape and contains teeth 17 projecting approximately toward the center of the closed slot 11. The notches 16 in the upwardly projecting cylindrical portion 8*a* of the bung 6 and the teeth 17 in the closed slot 11 of the locking plate 10 are of such shape and relative spacing so as to mesh with each other when the locking plate 10 engages the upwardly projecting cylindrical portion 8*a* of the bung 6. The central cylindrical portion 8*a* of the bung 6 contains holes 18 and 19 near the top thereof and is of sufficient length such that when the teeth 17 of the locking plate 10 mesh with the notches 16 of the central cylindrical portion 8*a* of the bung 6, holes 18 and 19 can receive the shackle 13 of the padlock 14.

Figure 6:
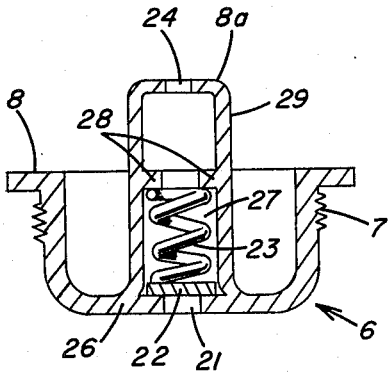
FIG. 6 represents a view in cross section of the bung 6 in FIG. 5.

The bung 6 of this preferred embodiment is shown in cross section in FIG. 6. The wall 29 of the upwardly projecting central cylindrical portion 8*a* defines a cavity 27 fitted with a spring 23 which contacts a disc 22 covering the opening 21 in the bottom wall 26 of the bung 6 and also contacts, at a position upwards of the disc 22, a washer shaped large 28 rigid with the inside of wall 29. The uppermost end of wall 29 defines the opening 24 in the central cylindrical portion 8*a*. The holes 18 and 19 (shown in FIG. 5) near the top of the upwardly projecting cylindrical portion 8*a* of the bung 6 for receiving the shackle of a padlock are not shown in FIG. 6.

The notches 16 is the upwardly projecting portion 8*a* of the bung 6 and the teeth 17 in the closed slot 11 of the locking plate 10 in the preferred embodiment represented in FIGS. 4 and 5 provide the ability to engage the locking plate 10 to the bung 6 so as to minimize, and preferably essentially eliminate, rotation of the bung 6 in the receptacle 4 before the member 12 of the locking plate 10 contacts the outside wall 2 of the container 1 and/or contacts the perimeter of the lip 15 of the substantially closed end 3 of the container 1.

Figure 7:
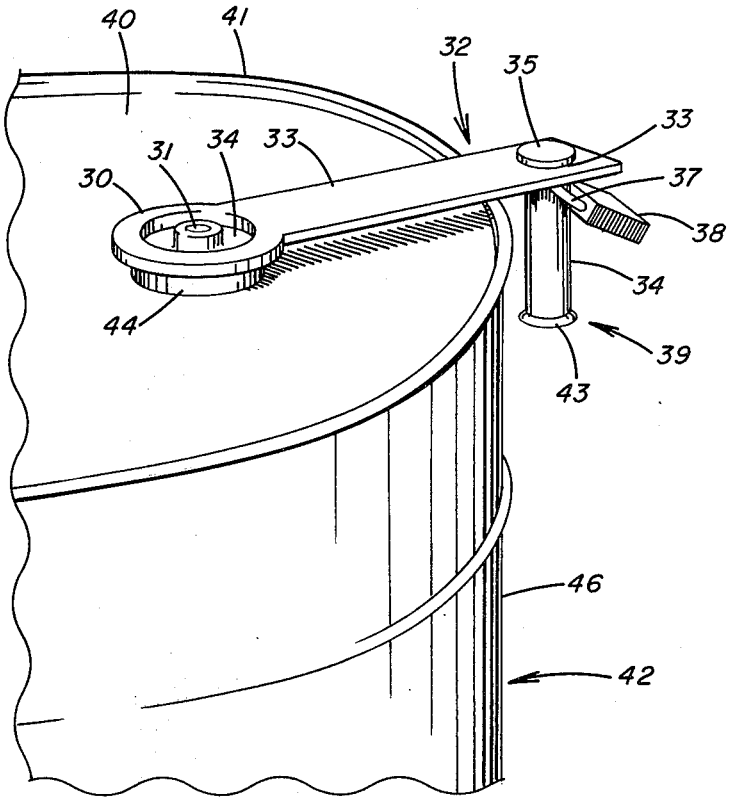
FIG. 7 represents a view in perspective of an embodiment of the invention in assembled form.
Figure 8:
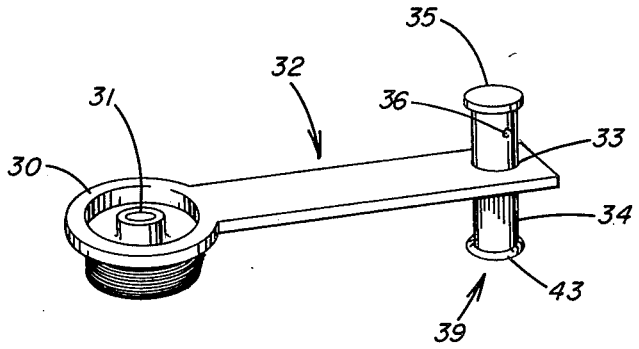
FIG. 8 represents a view in perspective of a portion of FIG. 7 with member 34 in a different position.

FIGS. 7 and 8 illustrate a fifth embodiment of the invention. The container 42 having cylindrical wall 46, substantially closed end 40 and receptacle 44 is the same as in the first embodiment of the invention described above. However, in this fifth embodiment, the top of the bung 30, which preferably contains a vent 31, is rigidly fixed or integral with the elongated locking plate 32 near one end 33 of the locking plate. If the bung 30 does contain a vent 31, it is preferable that the locking plate 32 contain an aperture 34 in the region of the locking plate 32 where the plate is rigidly fixed to the bung 30 so as to permit venting through both the vent 31 of the bung 30 and the aperture 34 in the locking plate 32. In approximately longitudinal relationship to the position on the locking plate where the plate is rigidly fixed to the top of the bung 30, the locking plate 32 contains at least one bore 33 completely through the plate for slidingly receiving a member 34, such as a solid or hollow bar, solid rod, or pipe, which member 34 has means 35 near the upper end thereof for preventing the passage of such upper end 35 through the bore 33 in the locking plate 32. Some examples of such means 35 include a flared portion of the upper end of the member 34, or a cap at the upper end of the member 34, which flared end or cap is incapable of downward passage through the bore 33 in the locking plate 32. The member 34 additionally contains a hole 36 (illustrated in FIG. 8) for receiving the shackle 37 of a lock 38. The hole 36 in the member 34 is located at a position sufficiently distal from the bottom end 39 of the member 34 so that when the member 34 is positioned in the bore 33 with the hole 36 located beneath the bore 33 and the shackle 37 of a lock 38 is inserted through the hole 36, the member 34 cannot be moved in an upward direction a sufficient distance for the bottom end 39 of the member 34 to clear the substantially closed end 40 and for the perimeter and/or of the lip 41 of the substantially closed end 40 of the container 42. It is preferable in this embodiment of the invention that the member 34 also have means 43 near the lower end 39 thereof for preventing the passage of such lower end 39 through the bore 33 in the locking plate 32. The length of the locking plate 32, the length of the member 34, and the position of the hole 36 may of course vary provided that the aforementioned lengths are sufficient and the position of the hole 36 is such that when the securing device is locked in assembled form, the rotation of the bung 30 in the receptacle 44 is at least partially restricted by the contact of the member 34 with the outside wall 46 of the container 42 and/or by contact with the perimeter of the lip 41 of the substantially closed end 40 of the container 42. An additional advantage provided by the securing device of this embodiment of the invention is that once the securing device is unlocked, the member 34 can be slid upward in the bore 33 of the locking plate 32 and can be used to assist in removing the bung from the container.

Figure 9:
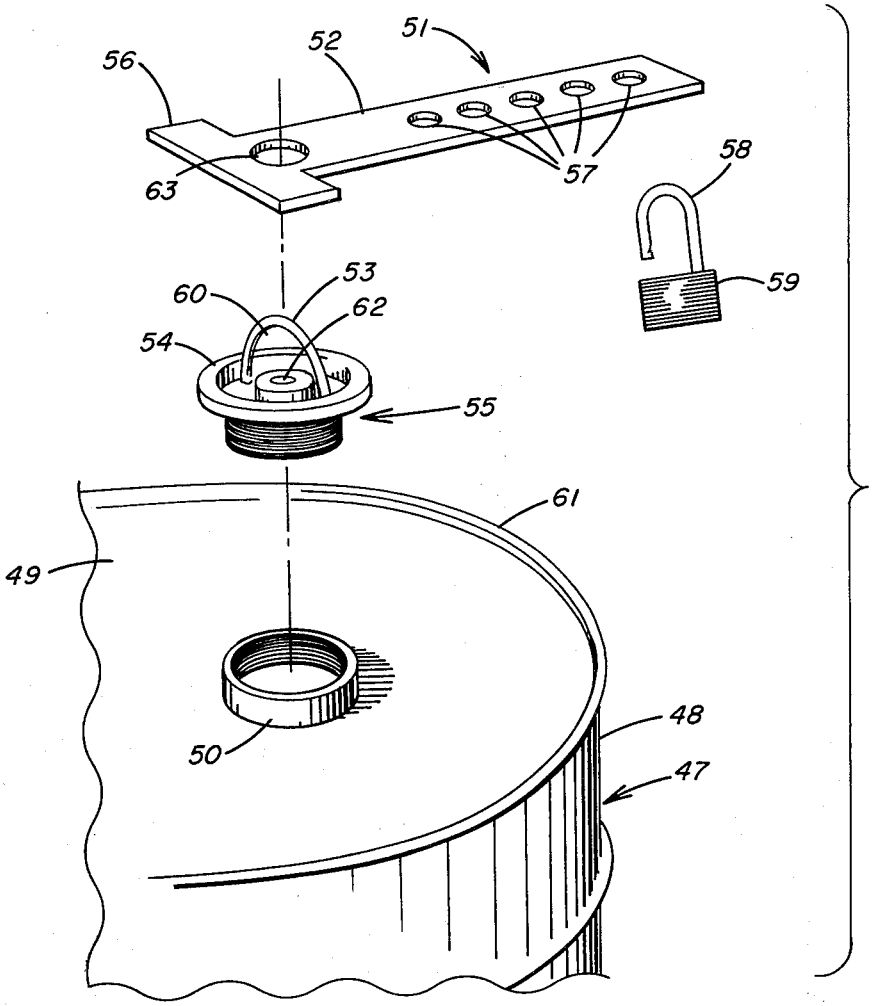
FIG. 9 represents a view in perspective of an embodiment of the invention in an unassembled condition.
Figure 10:
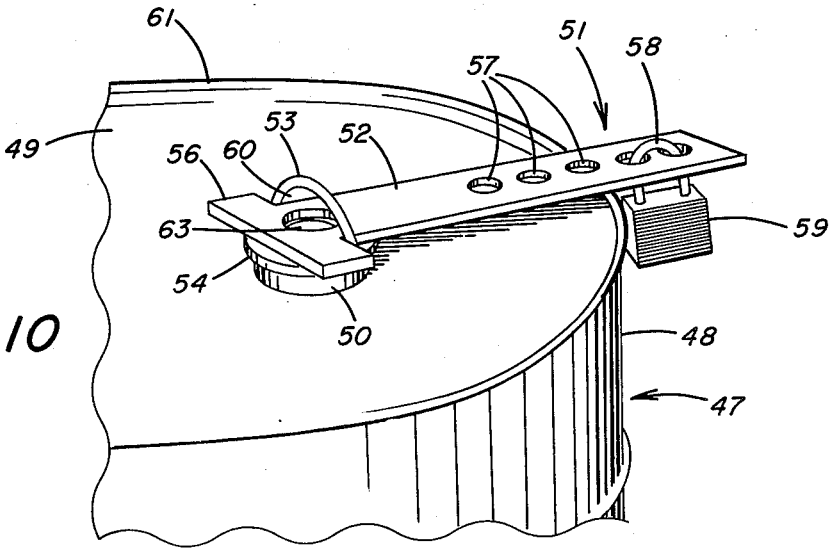
FIG. 10 represents a view in perspective of the embodiment represented in FIG. 9 but in an assembled condition.

FIGS. 9 and 10 illustrate a sixth embodiment of the invention. The container 47 having cylindrical wall 48, substantially closed end 49 and receptacle 50 is the same as in the first embodiment of the invention described above. However, in this sixth embodiment, the elongated locking plate 51 has a narrow section 52 of predetermined width to permit the narrow section 52 to pass through the aperture 60 of the outwardly projecting member 53 rigid with the upper end 54 of the bung 55, which outwardly projecting member in this embodiment is a ring 53. The eloogated locking plate 51 also contains a broad section 56 wider than the previously described narrow section 52 and of sufficient width so as to prevent passage of the broad section 56 through the aperture 60 of the outwardly projecting member 53 rigid with the upper end 54 of the bung 55. The narrow section 52 of the locking plate 51 contains a plurality of spaced, closed slots 57 located along the direction of the length of the narrow section 52. The slots 57 are sufficiently large and spaced adjacent to one another a sufficient distance so as to permit the shackle 58 of a lock 59 to pass through adjacent slots of the plurality of spaced, closed slots 57 when the lock is in an open condition. Thus, depending on the number of spaced, closed slots located in that section of the locking plate 52 extending beyond the perimeter of the substantially closed end 49 of the container 47, when the securing device is in an assembled condition the lock 59 can be attached by means of the shackle 58 through adjacent slots at a position close to the outside wall 48 of the container 47 and/or close to the perimeter of the substantially closed end 49 of the container 48. The size and shape of the aperture 60 of the outwardly projecting member 53 of the bung 55, the length of the broad section 56 of the locking plate 51, and the height of the lock, all can be predetermined so that when the securing device is in as assembled, locked condition, the upward movement of the narrow section 52 of the locking plate 51 is sufficiently restricted by contact of the broad section 56 with the top of the bung 54 itself and/or with the substantially closed end 49 of the container 47 and by contact of the narrow portion 52 of the locking plate 51 with that part of the outwardly projecting member 53 defining the perimeter of the aperture 60 so that the bottom of the lock 59 cannot be raised above the substantially closed end 49 and/or the perimeter of the lip 61 of the substantially closed end 49 of the container 47. Moreover, the length of the narrow section 52 of the locking plate 51 and the height of the lock 59 may of course vary provided they are of sufficient lengths such that when the securing device is in assembled form, the rotation of the bung 55 in the receptacle 50 is at least partially restricted by contact of at least part of the lock 59 with the outside wall 48 of the container 47 and/or by contact with the perimeter of the lip 61 of the substantially closed end 49 of the container 47. Advantages of this sixth embodiment include the absence of a member rigidly fixed to the locking plate such as member 12 in the first embodiment described above and substitution therefor of the lock itself, and also the ability to adjust the position of the lock on the locking plate so as to minimize possible rotation of the bung in the receptacle.

It will be appreciated that the top of the bung in the sixth embodiment of the invention can be rigidly fixed to or integral with the elongated locking plate similar to the way the top of the bung 30 is rigidly fixed to or integral with the locking plate 32 shown in FIG. 8. Additionally, when the bung 55 (shown in FIG. 9) contains a vent 62, it is preferable that the locking plate 51 contain an aperture 63 in the region of the locking plate 51 where the plate would otherwise cover the vent 62 in the bung 55 so as to permit venting through both the vent 62 and the aperture 63 in the locking plate 51.

It should be understood that the foregoing description is merely illustrative of the invention. In principle, the invention may be employed on many containers of various sizes and shapes which have a substantially closed end with or without a raised lip, such as at the perimeter of the substantially closed and, and which have an appropriate receptacle for receiving a bung.

What is claimed is:

1. A securing device for a container which container has a wall and a substantially closed and, the substantially closed end having a hole defined by a receptacle having means for rotatably receiving a bung, said securing device comprising: a bung having a wall provided with means for rotatably engaging the receptacle and an upper end having an outwardly projecting member rigid with said upper end, said outwardly projecting member having an aperture adapted for receiving a lock; and an elongated locking plate having a closed slot near one end for receiving said projecting member and a second member in longitudinal relation to said slot rigid with said locking plate and projecting from the surface thereof for engaging the outside wall of, and/or the perimeter of the substantially closed end of, the container.

2. The securing device of claim 1 wherein said outwardly projecting member lies in a plane approximately normal to said closed end of said bung.

3. The securing device of claims 1 or 2 wherein said second member projects from the surface of said locking plate in a plane approximately perpendicular thereto.

4. The securing device of claim 3 wherein said bung has a cylindrical wall provided with screw shaped threads on the external surface thereof for rotatably engaging the receptacle.

5. The securing device of claim 4 wherein said second member is selected from a solid or hollow bar, a solid rod, or a pipe.

6. A securing device for a container, which container has a cylindrical wall and a substantially closed end having a hole defined by a threaded receptacle for receiving a bung, ccomprising: a bung, for rotatatly engaging the threaded receptacle, having a cylindrical wall provided with screw shaped threads on the external surface thereof, and an upper end having an outwardly projecting member rigid with said upper end and lying in a plane essentially normal thereto, said outwardly projecting member having an aperture adapted for receiving a lock; and an elongated locking plate having a closed slot near one end for receiving said projecting member, and a second member selected from a hollow or solid bar, a solid rod or a pipe, rigid with said locking plate and arranged in longitudinal relationship to said slot and projecting approximately perpendicularly from said locking plate for engaging the outside wall of and/or the perimeter of the substantially closed end of the container so as to at least partially restrict rotational movement of said bung in the receptacle.

7. A securing device for a container which container has a raised lip defining a substantially closed surface of a substantially closed end of a container and within said substantially closed surface a hole defined by a receptacle having means for rotatably receiving a bung, said securing device comprising: a bung having a wall provided with means for rotatably engaging the receptacle and an upper end having an outwardly projecting member rigid with said upper end, said outwardly projecting member having an aperture adapted for receiving a lock; and an elongated locking plate having a closed slot near one end for receiving said projecting member, said locking plate being of sufficient length such that said locking plate engaging said projecting member at least partially restricts rotation of said bung in the receptacle by contact of an end of said locking plate with the raised lip at a position on the raised lip facing the interior of the substantially closed surface of the substantially closed end of the container.

8. A securing device for a container which container has a wall and a substantially closed and, the substantially closed end having a hole defined by a receptacle having means for rotatably receiving a bung, said securing device comprising: a bung having a wall provided with means for rotatably engaging the receptacle and an upper end having located toward the center thereof and projecting outwardly therefrom a cylindrical member, said cylindrical member having on the outward curved surface thereof a plurality of notches and having an aperture adapted for receiving a lock; and an elongated locking plate having near one end thereof an approximately circular closed slot containing a plurality of teeth projecting approximately toward the center of said slot for receiving said cylindrical member, and a second member in longitudinal relation to said slot rigid with said locking plate and projecting from the surface thereof for engaging the outside wall of, and/or the perimeter of the substantially closed end of, the container.

9. A securing device for a container which container has a wall and a substantially closed end having a hole defined by a receptacle having means for rotatably receiving a bung, said securing device comprising: a bung having a wall provided with means for rotatably engaging the receptacle and having an upper end rigidly fixed to or integral with a first end of a locking plate, said locking plate having at least one bore in longitudinal relationship to said first end and within said bore a member capable of sliding within said bore, said member containing a hole for receiving a shackle of a lock, said hole located a sufficient distance from the bottom end of said member such that when the member is positioned to said bore with the shackle of the lock inserted through said hole, said member cannot be moved in an upward direction a sufficient distance for the bottom end of said member to clear the substantially closed end of the container.

10. A securing device for a container which container has a wall and a substantially closed end having a hole defined by a receptacle having means for rotatably receiving a bung, said securing device comprising: a bung having a wall provided with means for rotatably engaging the receptacle and an upper end having an outwardly projecting member rigid with said upper end, said outwardly projecting member having an apeture; and a locking plate having a first section of predetermined width sufficient to permit said first section to pass through said aperture of said outwardly projecting member and having a second section of predetermined width insufficient to permit said second section to pass through said aperture of said outwardly projecting member, said first section having along its length at least two closed slots for receiving a shackle of a lock for engaging the outside wall of, and/or the perimeter of the substantially closed end of, the container.

* * * * *